US006612053B2

(12) United States Patent
Liao

(10) Patent No.: US 6,612,053 B2
(45) Date of Patent: Sep. 2, 2003

(54) FLUID DECORATION

(76) Inventor: Chu-Yuan Liao, 5F-1, No. 177, Sec. 1-Ho-Ping E. Rd., Taipei (TW)

( * ) Notice: Subject to any disclaimer, the term of this patent is extended or adjusted under 35 U.S.C. 154(b) by 49 days.

(21) Appl. No.: 09/731,749

(22) Filed: Dec. 8, 2000

(65) Prior Publication Data

US 2002/0069565 A1 Jun. 13, 2002

(51) Int. Cl.[7] ..... G09F 19/00
(52) U.S. Cl. ..... 40/406; 40/407
(58) Field of Search ..... 40/406, 407

(56) References Cited

U.S. PATENT DOCUMENTS 5,396,723 A * 3/1995 Liu ..... 40/406
6,311,420 B1 * 11/2001 Wu ..... 40/406
6,318,010 B1 * 11/2001 Tsai ..... 40/406

* cited by examiner

*Primary Examiner*—Cassandra H. Davis
(74) *Attorney, Agent, or Firm*—Troxell Law Office PLLC

(57) ABSTRACT

Fluid decoration including a soft transparent or semitransparent envelope body and a seat body. At least two kinds of fluids with different specific weights and colors are filled in the envelope body. An inlaid member is placed in a bottom end of the envelope body. The bottom end is then sealed. The inlaid member has an upward extending patterned article. An ejecting device is disposed in the patterned article. The ejecting device is composed of a tube body and a driving unit connected with the tube body. A top end of the tube body is formed with an ejecting opening. The periphery of the tube body near the bottom thereof is formed with through holes. When the driving unit is powered on, the heavier fluid is pumped through the through hole into the tube body and forcedly pushed upward. The heavier fluid is then upward ejected from the ejecting opening of the ejecting device. Thereafter, the heavier fluid gradually splashes down onto the bottom of the envelope body. The above cycle is repeated to achieve a dynamic colorful decorative view.

9 Claims, 3 Drawing Sheets

FLUID DECORATION

BACKGROUND OF THE INVENTION

The present invention is related to a fluid decoration including a soft transparent or semitransparent envelope body in which a patterned article and at least two kinds of fluids with different specific weights and colors are contained. A driving unit is disposed in the patterned article for pushing the fluids to flow so as to achieve a dynamic colorful decorative view.

A conventional fluid decoration generally has a transparent outer housing made of hard material. Fluids and decorative articles such as ships, fishes or the like are contained in the housing. When shaking or turning the fluid decoration upside down, the fluids will be disturbed to create a dynamic view. However, such view is monotonous and must be created by manually shaking the fluid decoration. Moreover, the housing of the fluid decoration is made of hard material. In case of incautious dropping, the fluid decoration is very likely to be broken. As a result, the fluids, decorative articles and the hard fragments will scatter around.

SUMMARY OF THE INVENTION

It is therefore a primary object of the present invention to provide a fluid decoration including a soft transparent or semitransparent envelope body and a seat body. At least two kinds of fluids with different specific weights and colors are filled in the envelope body. An inlaid member is placed in a bottom end of the envelope body. The bottom end is then sealed. The inlaid member has an upward extending patterned article. An ejecting device is disposed in the patterned article. The ejecting device is composed of a tube body and a driving unit connected with the tube body. A top end of the tube body is formed with an ejecting opening. The periphery of the tube body near the bottom thereof is formed with through holes. When the driving unit is powered on, the heavier fluid is pumped through the through hole into the tube body and forcedly pushed upward. The heavier fluid is then upward ejected from the ejecting opening of the ejecting device. Thereafter, the heavier fluid gradually splashes down onto the bottom of the envelope body. The above cycle is repeated to achieve a dynamic colorful decorative view.

It is a further object of the present invention to provide the above fluid decoration in which the envelope body is made of very soft material so that a user not only can watch the view, but also can squeeze the envelope body to indirectly touch the patterned article contained in the envelope body. Therefore, in addition to the visual decorative effect, another entertaining effect can be achieved. Moreover, in case of dropping, the soft envelope body provides a buffering effect to protect the fluid decoration from breaking.

The present invention can be best understood through the following description and accompanying drawings wherein:

DETAILED DESCRIPTION OF THE PREFERRED EMBODIMENT

Figure 1:
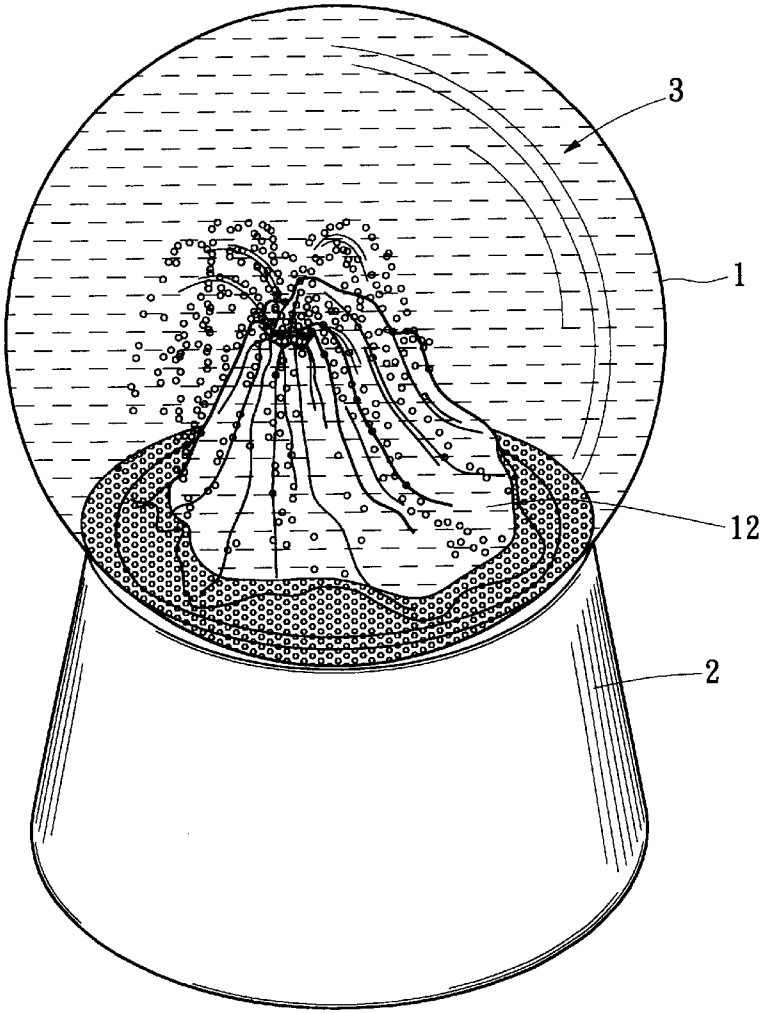
FIG. 1 is a perspective view of the fluid decoration of the present invention.
Figure 2:
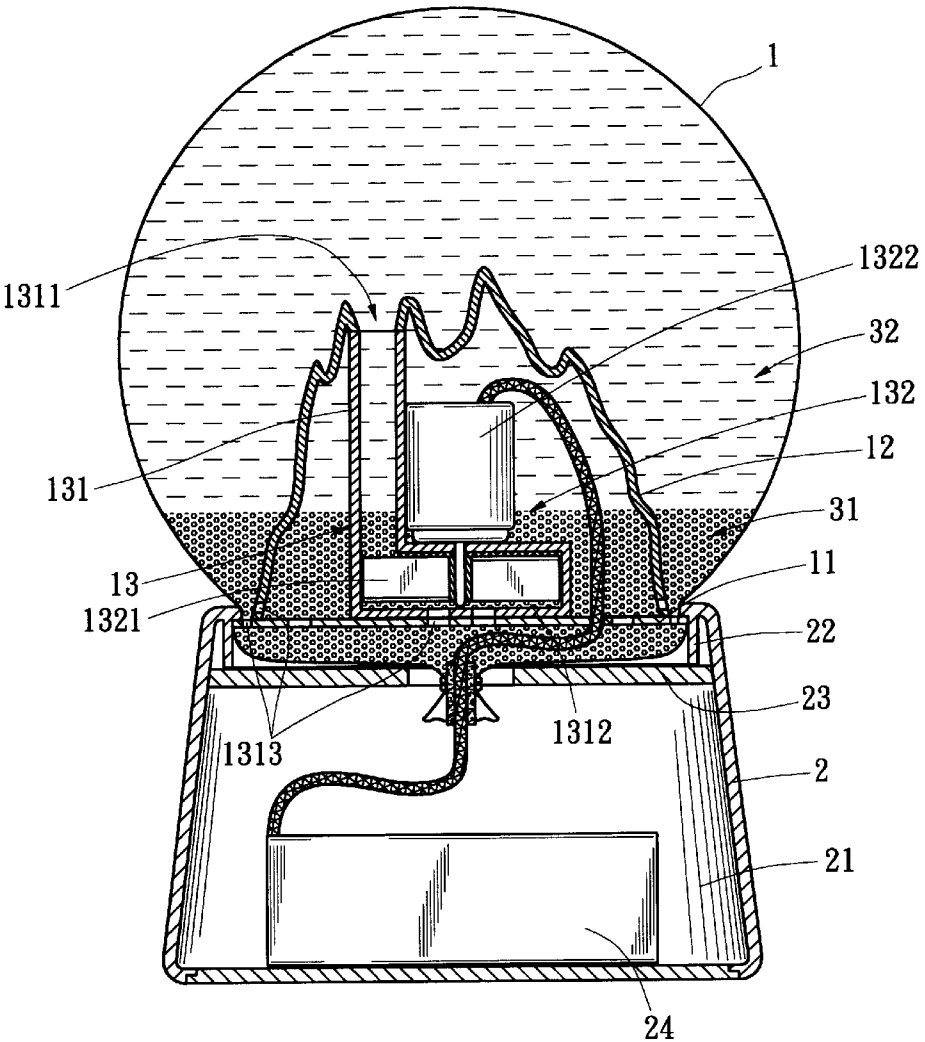
FIG. 2 is a plane sectional view of the fluid decoration of the present invention.

Please refer to FIGS. 1 and 2. The fluid decoration of the present invention includes an envelope body 1 and a seat body 2. The envelope body 1 is made of very soft transparent or semitransparent material and has an open end. At least two kinds of fluids 3 with different specific weights and colors are filled in the envelope body 1. As shown in FIGS. 1 and 2, a first fluid 31 and a second fluid 32 are contained in the envelope body 1. An inlaid member 11 is placed in the envelope body 1. The inlaid member 11 has an upward extending patterned article 12. An ejecting device 13 is disposed in the patterned article 12. The ejecting device 13 is composed of a tube body 131 as a fluid passage and a driving unit 132 disposed on inner side of the tube body 131. The upper end of the tube body 131 is formed with an ejecting opening 1311 communicating with outer side of the patterned article 12. A sucking section 1312 is formed near the bottom end of the tube body 131. The periphery of the sucking section 1312 is formed with at least one through hole 1313. The driving unit 132 is disposed in the sucking section 1312. The driving unit 132 is composed of a motor 1322 and a flow-guiding vane assembly 1321 fitted on a shaft of the motor and driven by the motor 1322.

The seat body 2 defines therein a chamber 21. The top side of the chamber 21 is formed with an opening. The inner circumference of the opening is formed with an insertion section 22. The envelope body 1 is downward passed through the opening of chamber 21 and then the inlaid member 11 is enclosed in the envelope body 1. Then the inlaid member 11 is inlaid into the insertion section 22 from inner side of the seat body 2 to the top section thereof. A fixing member 23 is upward engaged with lower side of the insertion section 22. Accordingly, the open end or bottom end of the envelope body 1 is collectively retained between the inlaid member 11 and the fixing member 23. The open end of the envelope body 1 is bound or sealed into a sealed state. A power supply 24 is disposed in the chamber 21 under the fixing member 23. The power supply 24 is connected with a wire conducted through the open end of the envelope body 1 into the envelope body 1 to electrically connect with the driving unit 132. The power supply 24 supplies necessary power for the motor 1323 of the driving unit 132 to operate.

Figure 3:
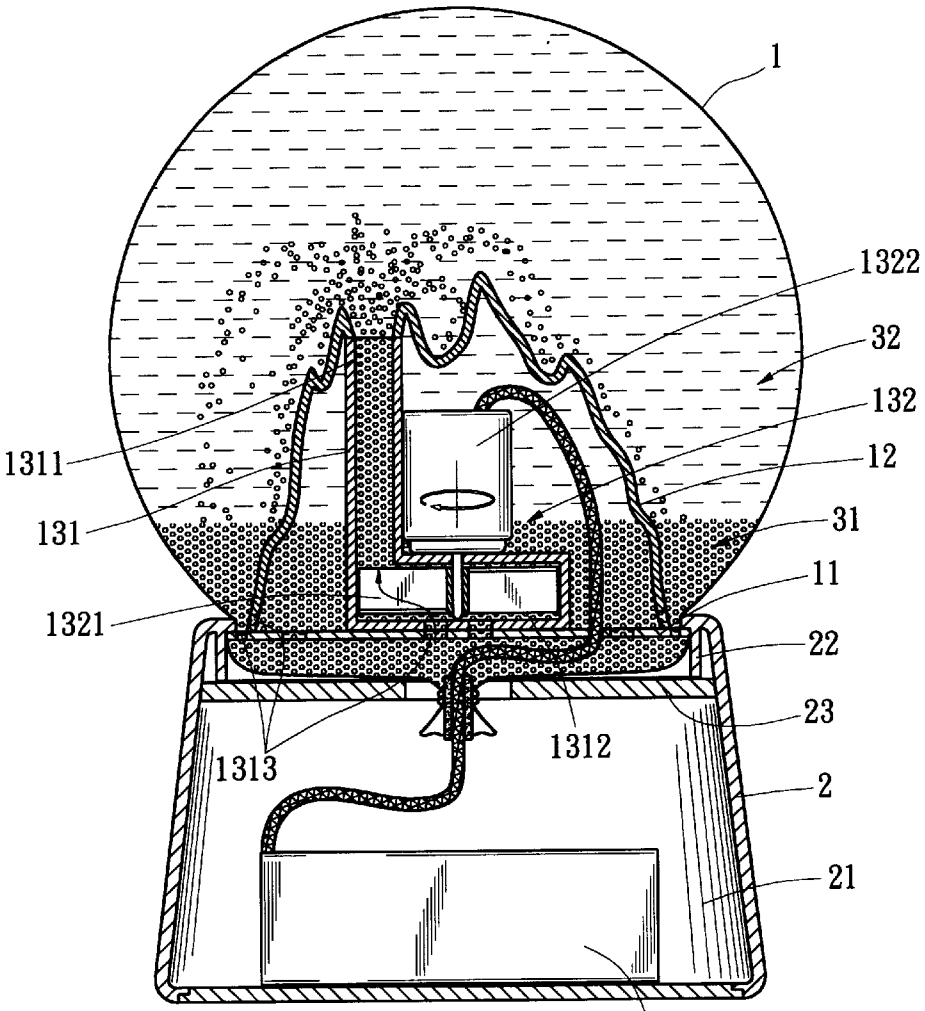
FIG. 3 is a plane sectional view of the fluid decoration of the present invention, showing the ejection and splashing of the heavier fluid contained in the envelope body.

Referring to FIG. 3, when the motor 1323 is powered on by the power supply 24, the flow-guiding vane assembly 1321 is driven and rotated. At this time, the heavier first fluid 31 is pumped through the through hole 1313 into the lower end of the tube body 131 and abruptly forcedly pushed upward. The first fluid 31 is thus upward ejected from the ejecting opening 1311 of the tube body 131. Thereafter, due to larger specific weight, the first fluid 31 gradually splashes down onto the bottom to be re-pumped. The above cycle is repeated to achieve a dynamic decorative view.

The envelope body 1 is made of very soft material so that a user not only can watch the view, but also can squeeze the envelope body 1 to indirectly touch the patterned article 12 contained in the envelope body 1. Therefore, in addition to the visual decorative effect, another entertaining effect can be achieved. Moreover, in case of dropping, the soft envelope body 1 provides a buffering effect to protect the fluid decoration from breaking.

The above embodiment is only used to illustrate the present invention not intended to limit the scope thereof. Many modifications of the above embodiment can be made without departing from the spirit of the present invention.

What is claimed is:

1. Fluid decoration comprising an envelope body and a seat body, the envelope body being a soft transparent or semitransparent envelope body, at least two kinds of fluids with different specific weights and colors being filled in the envelope body, an inlaid member being placed in a bottom end of the envelope body, the inlaid member having an upward extending patterned article, an ejecting device being disposed in the patterned article, the ejecting device including at least one fluid passage formed in the patterned article, a periphery of the fluid passage near the bottom thereof being formed with through holes, the fluid passage being formed with an ejecting opening communicating with outer side of the patterned article, a driving unit being disposed in the fluid passage, the seat body defining therein a chamber, a top end of the chamber being formed with an opening, an inner circumference of the opening being formed with an insertion section, the inlaid member being enclosed in the envelope body and inlaid in the insertion section, whereby when the ejecting device is driven, a heavier fluid contained in the envelope body is pushed through a through hole into the fluid passage and upwardly ejected from the ejecting opening thereof and then the heavier fluid gradually splashes down to create a dynamic decorative view.

2. Fluid decoration as claimed in claim 1, wherein a sucking section is formed near a bottom end of the fluid passage, a periphery of the sucking section being formed with at least one through hole, a rotary flow-guiding vane assembly being disposed in the sucking section.

3. Fluid decoration as claimed in claim 2, wherein the driving unit is composed of a motor and a flow-guiding vane assembly fitted with a shaft of the motor.

4. Fluid decoration as claimed in claim 2, wherein a power supply is installed in the seat body for supplying power for the driving unit.

5. Fluid decoration as claimed in claim 1, wherein the driving unit is composed of a motor and a flow-guiding vane assembly fitted with a shaft of the motor.

6. Fluid decoration as claimed in claim 1, wherein a fixing member is engaged with lower side of the insertion section to isolate a bottom end of the envelope body from the interior of the seat body.

7. Fluid decoration as claimed in claim 6, wherein a lower end of the envelope body is an open end, after the inlaid member is enclosed in the envelope body, the lower open end of the envelope body under the inlaid member being sealed.

8. Fluid decoration as claimed in claim 1, wherein a lower end of the envelope body is an open end, after the inlaid member is enclosed in the envelope body, the lower open end of the envelope body under the inlaid member being sealed.

9. Fluid decoration as claimed in claim 1, wherein a power supply is installed in the seat body for supplying power for the driving unit.

* * * * *